United States Patent [19]

Vahjen et al.

[11] Patent Number: 4,934,567

[45] Date of Patent: Jun. 19, 1990

[54] HYBRID BEVERAGE MIXING AND DISPENSING SYSTEM

[75] Inventors: Bruce J. Vahjen, Yorktown Heights; Martin Berger, Dobbs Ferry, both of N.Y.

[73] Assignee: PepsiCo, Purchase, N.Y.

[21] Appl. No.: 75,104

[22] Filed: Jul. 20, 1987

[51] Int. Cl.[5] ..... B67D 5/52

[52] U.S. Cl. ..... 222/136; 222/146.6; 222/145; 99/275; 99/323.5

[58] Field of Search ..... 222/129.1–129.4, 222/135, 136, 146.6, 145; 99/275, 323.5

[56] References Cited

U.S. PATENT DOCUMENTS

| | | | |
|---|---|---|---|
| 2,440,365 | 4/1948 | Copping et al. . | |
| 3,393,631 | 6/1968 | Harrison . | |
| 3,625,399 | 12/1971 | Heisler | 222/136 X |
| 3,640,433 | 2/1972 | Rodth | 222/146.6 X |
| 3,643,688 | 2/1972 | Meinert . | |
| 3,823,571 | 7/1974 | Smith et al. | 222/129.3 X |
| 3,832,474 | 8/1974 | Karr | 99/275 X |
| 3,938,537 | 2/1976 | Kalko et al. . | |
| 3,960,066 | 6/1976 | LaRocco et al. | 99/323.2 |
| 3,960,295 | 6/1976 | Horak | 222/145 |
| 4,216,711 | 8/1980 | Skoli et al. . | |
| 4,270,673 | 6/1981 | Rodth . | |
| 4,349,130 | 9/1982 | Bair . | |

*Primary Examiner*—Joseph J. Rolla
*Assistant Examiner*—David H. Bollinger
*Attorney, Agent, or Firm*—Scully, Scott, Murphy & Presser

[57] ABSTRACT

A hybrid postmix beverage mixing and dispensing system wherein a beverage is mixed at an account from carbonated water and syrup, the brix ratio of which is precisely controlled by the use of a ratio proportioning pump. The mixed beverage is then delivered to a stabilizing tank, to stabilize the beverage and minimize problems with foaming thereof during dispensing. A single product delivery line then extends from the stabilizing tank to a relatively simple two way valve at the dispensing counter or station. The system is repeated for each different flavor available at the account.

2 Claims, 2 Drawing Sheets

HYBRID BEVERAGE MIXING AND DISPENSING SYSTEM

BACKGROUND OF THE INVENTION

1. Field of the Invention

The present invention relates generally to a hybrid beverage mixing and dispensing system which incorporates therein several features of prior art premix systems and also selected features from prior art postmix systems.

More particularly, the present invention relates to a postmix system wherein a beverage is mixed at an account from carbonated water and syrup, the mix ratio of which is precisely controlled by the use of a ratio proportioning pump. The mixed beverage is then delivered to a stabilizing tank, to stabilize the beverage and minimize problems with foaming thereof during dispensing. A single product delivery line extends from the stabilizing tank to a relatively simple two way valve at the dispensing counter or station.

2. Discussion of the Prior Art

Generally, the prior art in the dispensing of fountain beverages is divided into premix systems where finished beverage is delivered to the proprietor from the bottler, and postmix systems where fountain syrup is delivered to the proprietor and mixed with water from the site at the point of delivery.

A postmix system generally utilizes soft drink syrup typically delivered in pressurized containers, bag-in-box containers, or one gallon delivery jugs. This syrup is combined with carbonated or still water at typically a 5 to 1 ratio through a dispensing valve at the counter having passages for both syrup and water. The valve combines the syrup and water immediately before delivery into a cup on an individual serving basis. This dispensing valve at the counter is adjustable to adjust the mix ratio of the delivered beverage, and is frequently a source of problems as persons at the account often attempt an adjustment thereof, and oftentimes do not correctly adjust the valve, thereby resulting in the delivery of a beverage with an incorrect mix ratio.

A premix system generally utilizes product containers (usually five gallon transfer tanks) filled with finished soft drink under $CO_2$ pressure. That is, the syrup and water are already combined and are in a bulk container, under $CO_2$ pressure, in finished drink form. In these systems, the product is normally delivered to the consumer via a single orifice dispensing valve. Premix systems are also used in bottling plants which typically operate at extremely high product flow rates, such as in excess of ten thousand gallons of product per minute, and are relatively expensive installations, not at all suitable for typical account installations.

For instance, Karr, U.S. Pat. No. 3,832,474 discloses a premix system for a bottling plant for continuously preparing a carbonated product and filling containers therewith. The system includes, in series, a carbonator, a stabilizing tank, a pressure reduction tank, and a filler. After a carbonated product is formed by applying carbon dioxide to it in the carbonator, the carbonated product is passed to a stabilizing tank which includes a valve assembly connected to a source of carbon dioxide under pressure for regulating the head pressure of carbon dioxide over the carbonated product to be at least equal to the carbonating pressure. Thereafter, the carbonated product is passed to the pressure reduction tank which includes a second valve assembly for regulating the head pressure of carbon dioxide over the carbonated product at a predetermined level below the carbonating pressure. Then the carbonated product is passed directly to a filler at which it is dispensed into containers. This patent mentions production rates of fifteen to twenty gallons per minute, which equates to production rates of 900 to 1200 gallons per hour.

La Rocco, et al., U.S. Pat. No. 3,960,066 also discloses a premix system for a bottling plant in which chilled water from a cooling system is pumped into a carbonation and saturation tank, from which the chilled carbonated water flows to a positive displacement metering pump for the delivery of metered amounts of carbonated water. The positive displacement metering pump also delivers metered amounts of syrup, and the metered quantities of syrup and carbonated water are joined at a tee where they are mixed, and are then fed to a balance tank to provide a product reservoir and stabilizing area, from which the product flows to a bottle or can filling machine. This patent mentions production rates of 1,500 to 12,000 gallons per hour depending upon the size of the bottling plant. The La Rocco system stresses chilling of the water prior to carbonation, then carbonating the chilled water at a higher than usual temperature by passing it through a filamentary metal mass in a carbon dioxide atmosphere, and blending the chilled carbonated water with syrup by using two positive-displacement pumping heads driven in common through pumping strokes of adjustable length.

The prior art bottling systems as disclosed by Karr and La Rocco, et al. contemplate large production rates to supply bottle and can filling equipment, and the expense of such systems would not economically justify the use of similar systems in a typical postmix account environment for the low flow rates provided thereat for filling cups at a dispensing counter or station.

SUMMARY OF THE INVENTION

Accordingly, it is a primary object of the present invention to provide a hybrid postmix dispensing system for an account which delivers a more uniform and consistent beverage product than is available in similar postmix systems in the prior art.

A further object of the subject invention is the provision of a hybrid postmix dispensing system as described which can be installed in new accounts with a minimum of expense and equipment, and which can be retrofitted to existing postmix accounts with a minimum amount of new equipment and accompanying expense.

In accordance with the teachings herein, the present invention provides a hybrid postmix system for mixing and dispensing a carbonated soft drink beverage into cups for direct delivery to consumers at the account. The account is provided with a source of concentrated syrup and also with a water carbonator. A ratio proportioning pump is coupled to the source of concentrated syrup and the water carbonator, and delivers therefrom a precise ratio of syrup to carbonated water, which is mixed and delivered to a beverage stabilizing tank for the mixed beverage. The beverage stabilizing tank stabilizes the carbonated beverage, to minimize problems with foaming during dispensing, and also provides optimized storage conditions for the beverage. A product delivery station at the account is equipped with a simple two way dispensing valve which is coupled to the beverage stabilizing tank by a beverage delivery line, to control dispensing of the delivered beverage into cups for direct delivery to consumers.

In greater detail, at the account premises the product delivery station is normally located by a counter for serving consumers, and the account premises includes a backroom area, generally nonaccessible to consumers, which houses the source of concentrated syrup, the water carbonator, the ratio proportioning pump, and the beverage stabilizing tank, and the beverage delivery line is a single line extending between the beverage stabilizer tank and the product delivery station. Moreover, the product delivery station incorporates therein a heat exchanger plate or other cooling means for cooling the dispensed beverage just prior to dispensing, such that the beverage is delivered noncooled from the backroom area through the beverage delivery line to the product dispensing station at which it is cooled.

The present invention generally moves the point of mixing from point of delivery, as in postmix, to a point upstream in the system but after the bottler. Additionally, the present invention is particularly concerned with the manner in which the finished beverage is stabilized after mixing to effect an acceptable level of foam at pouring. More particularly, the present invention places a stabilizing tank at the output of a ratio proportioning pump. The hybrid system of the present invention utilizes the soft drink syrup associated with postmix systems, combines the syrup with carbonated water in a ratio proportioning pump at the retailer, stabilizes the mixed beverage in a stabilizing tank, and then delivers the finished beverage, still under pressure, to a single orifice valve for dispensing of individual drinks at a counter.

The advantages of such a hybrid system are numerous. The delivery economics of syrup from the plant to the retailer remain. Any syrup delivery system can be utilized, e.g., transfer tanks, bag-in-box containers, bulk delivery systems, or otherwise. No changes in product handling are necessary, the hook-up and stock rotation remain the same as with an existing postmix system. Additionally, products with different, either higher or lower, mix ratios, e.g., 10 to 1, can be introduced by merely changing the delivery ratio of the ratio proportioning pump. The product quality is improved as the ratio pump delivers a very precisely controlled syrup and water mix ratio. Additionally, the accumulator/-stabilizer tank functions as an integrator to minimize errors. Dispensing should be consistent, with no variations due to line pressure variations or restrictions. Moreover, the field installations should be simple as only one finished product line for each flavor runs to the dispenser. Valve cost will be lower due to the simplification of the valve design. The valve will no longer have to mix, meter and dispense, and will only have to open and close to dispense the previously mixed beverage product. Sanitization will be easier for the retailer as no syrup will be present in the dispenser area. Maintenance will be reduced as Brix measurements and adjustments will no longer be necessary, and the simpler valve design should reduce service calls. The orifice sizes and pressures of the dispensing valve can be varied to accommodate pulp products, something existing valves cannot facilitate. All materials coming in contact with the product will be N.S.F. approved and product compatible.

The system will connect to existing postmix tanks, bag-in-box containers or other syrup sources via compatible fittings. Carbonated water can be fed to system from an existing carbonator system by suitable fittings.

The approach of the present invention results in accurate control over the mix ratio of the resultant beverage, resulting in improved drink quality, and moreover reduces the number of field adjustments required in a typical prior art mixing and dispensing system. In general, maintenance of the hybrid system of the present invention is reduced and simplified relative to prior art systems, resulting in reduced operating costs in addition to the reduced installation costs mentioned hereinabove.

Additionally, the design of the hybrid mixing and dispensing system of the present invention is modular in nature, allowing a progressive growth capability at an account.

BRIEF DESCRIPTION OF THE DRAWINGS

The foregoing objects and advantages of the present invention for a hybrid beverage mixing and dispensing system may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

Figure 1:
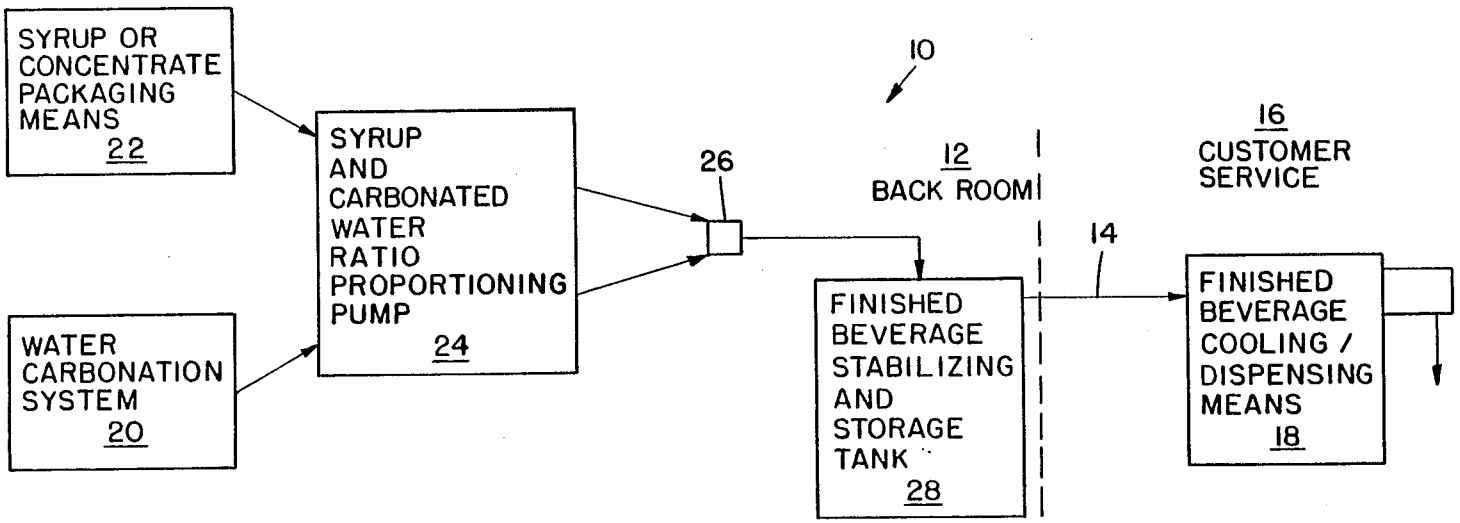
FIG. 1 is a schematic diagram of an exemplary embodiment of a hybrid beverage mixing and dispensing system constructed pursuant to the teachings of the present invention.

Referring to the drawings in detail, FIG. 1 is a schematic block diagram of an exemplary hybrid beverage mixing and dispensing system 10 constructed pursuant to the teachings of the present invention. The account premises is shown divided by a dashed line into a backroom storage area 12 at which are located most of the components of the present invention, and a customer service area 16. A room temperature mixed beverage is delivered from the backroom storage area 12 through a single product delivery line 14 to the customer service area 16 of the account. This area typically has a finished beverage dispenser 18 located at a product delivery station normally located by a counter for servicing customers, whereat a soft drink beverage is normally delivered in cups to customers. FIG. 1 illustrates one system 10 for the delivery of a single flavor soft drink, such as a cola. Multiple flavors available at a product delivery area would be serviced by multiple systems 10 as illustrated in FIG. 1, one for each flavor. In such systems, one common water carbonator 20 with a sufficient output might be utilized by all of the different flavor systems. The individual product delivery hoses 14 are normally coupled in common, and could be provided by one multiconduit hose assembly.

Referring specifically to FIG. 1, syrup from a syrup source 22 and carbonated water from a carbonation system 20 are introduced into a ratio proportioning pump 24, the output of which is an exact, fixed brix ratio of carbonated water to syrup (e.g. 5:1). Some commercially available ratio proportioning pumps are powered by the energy of the carbonated water stream, but alternative embodiments of the pump could be powered by other sources (compressed gas, electricity, etc.). A ratio proportioning pump is a proportioning pump that mechanically mixes two liquids to an exact ratio, and gives a consistent brix ratio in each and every drink. Commercially available ratio pumps, available from Micronyx Corp., and also from Shurflo Co., operate on the pressure of the water source, and generally are not adversely affected by temperature or pressure variations.

Downstream of the pump, the proportioned flows of syrup and water are mixed by a Y fitting 26 which simply joins the two lines into one, although more elaborate mixer arrangements might be utilized in alternative embodiments.

The mixed beverage then flows to a stabilizing and storage tank 28 which can be equipped with an inlet and an outlet fed through a dip tube. Although, alternative embodiments can be more complex, with a regulated gas supply for the headspace above the liquid, an automatic level control system, or other minor additions thereto. From the storage-stabilizer tank, the finished beverage flows through the product delivery line 14 to the dispensing station, at which is located a conventional cooler-dispenser for premix beverages. This apparatus exists and is essentially unchanged from present commercial equipment.

The entire system through to the product delivery line 14 operates at room temperature, such that the components thereof do not require cooling. All beverage cooling is done at the dispensing station, as in previously installed existing systems. In a preferred embodiment, all of the backroom operations are carried out at the ambient temperatures of the materials used therein, including the carbonated water and the flavor syrup, and the stabilizing tank is usually at or near room temperature, such that the soft drink temperature is normally delivered at or near the room temperature of the back storage room through the product delivery line 14 to the product dispensing station. The product dispensing station is of a type already well-known in the art, which includes a simple two-way (on-off) dispensing valve, typically electromagnetically operated, for each flavor beverage, and all of the beverages are caused to flow through a cold plate heat exchanger for cooling of the dispensed beverages just prior to delivery thereof to a customer.

Accordingly, the hybrid system of the present invention can be retrofitted fairly easily to many prior art accounts which are now equipped with a product dispensing station as described hereinabove.

Figure 2:
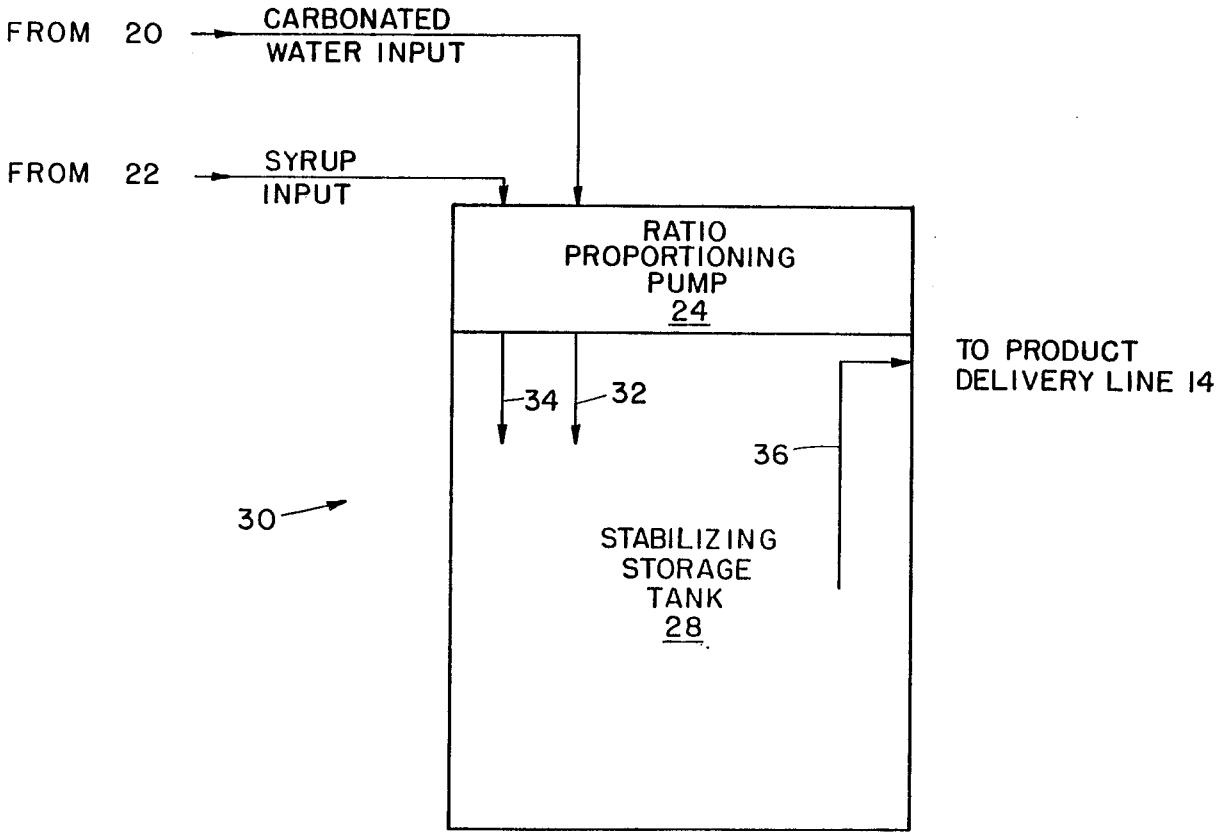
FIG. 2 is a schematic illustration of a slightly more detailed potential commercial embodiment of a hybrid beverage mixing and dispensing system in accordance with the subject invention.

FIG. 2 is a schematic illustration of a possible commercial system which is designed for a convenient retrofit to an existing system, and indicates the ratio proportioning pump 24 formed with the stabilizing tank 28 as one unit 30, with mixing occurring in the stabilizing tank 28. The stabilizing tank has two separate input lines 32, 34, respectively for carbonated water and syrup, with the input lines 32, 34 terminating at an appropriate level in the tank 28. A product delivery dip tube 36 has an input at an appropriate level in tank 28 and connected at its output to the product delivery line 14. Thus, in this arrangement one unit 30 needs to be supplied and connected by simple fittings for each different flavor carbonated beverage at an account.

Preliminary tests have indicated that the system functions as designed, delivering exactly proportioned and satisfactory drinks having a precisely accurate brix ratio.

While several embodiments and variations of the present invention for a hybrid beverage mixing and dispensing system are described in detail herein, it should be apparent that the disclosure and teachings of the present invention will suggest many alternative designs to those skilled in the art.

What is claimed is:

1. A hybrid, postmix system for mixing and dispensing a carbonated soft drink beverage at any account premises into cups for direct delivery to consumers, comprising:

a. a source of concentrated syrup at the account premises;

b. a water carbonator at the account premises connected to a source of water and a source of carbon dioxide for producing carbonated water;

c. a ratio proportioning pump, coupled to the source of concentrated syrup and the carbonated water produced by the water carbonator, for delivering a precise brix ratio of syrup to carbonated water;

d. a mixing means for mixing the delivered precise ratio of syrup and carbonated water to form a finished soft drink beverage;

e. a finished soft drink beverage stabilizing tank for the mixed beverage, to stabilize the finished soft drink beverage and minimize problems with foaming thereof during dispensing;

f. the account premises including a beverage product delivery station located by a counter for serving consumers, and a simple two way dispensing valve at said beverage product delivery station, coupled to said beverage stabilizing tank by a beverage delivery line, to control dispensing of the delivered finished soft drink beverage into cups for direct delivery to consumers; and g. the account premises further including a backroom area, nonaccessible to consumers, at which is located said source of concentrated syrup, said water carbonator, said ratio proportioning pump, said mixing means and said beverage stabilizing tank, and said beverage delivery line being a single noncooled line extending from said beverage stabilizing tank to said product delivery station, wherein the beverage is delivered noncooled through said beverage delivery line, and said product delivery station includes a heat exchanger for cooling the dispensing beverage at the product delivery station.

2. A hybrid postmix system for mixing and dispensing a carbonated soft drink beverage at an account into cups for direct delivery to consumers as claimed in claim 1, said ratio proportioning pump, said mixing means, and said beverage stabilizing tank comprising one integral unit which is designed to be coupled to inputs of syrup and carbonated water, and having an output coupled by said beverage delivery time to said dispensing valve.

* * * * *

UNITED STATES PATENT AND TRADEMARK OFFICE

CERTIFICATE OF CORRECTION

PATENT NO. : 4,934,567

DATED : June 19, 1990

INVENTOR(S) : Bruce J. Vahjen, et al.

It is certified that error appears in the above-identified patent and that said Letters Patent is hereby corrected as shown below:

Column 6, line 53, Claim 1: "dispensing" should read as --dispensed--

Column 6, line 62, Claim 2: "time" should read as --line--

Signed and Sealed this

Twenty-fifth Day of June, 1991

*Attest:*

*Attesting Officer*

HARRY F. MANBECK, JR.

*Commissioner of Patents and Trademarks*